US006568908B2

(12) United States Patent
Namura et al.

(10) Patent No.: US 6,568,908 B2
(45) **Date of Patent: *May 27, 2003**

(54) STEAM TURBINE

(75) Inventors: Kiyoshi Namura, Tokai (JP); Eiji Saito, Hitachi (JP); Yoshiaki Yamazaki, Hitachi (JP); Masakazu Takasumi, Jyuou (JP); Takeshi Onoda, Hitachi (JP); Shigemichi Inoue, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/028,677

(22) Filed: Dec. 31, 2001

(65) Prior Publication Data

US 2002/0057969 A1 May 16, 2002

Related U.S. Application Data

(62) Division of application No. 09/485,444, filed as application No. PCT/JP97/03130 on Sep. 5, 1997, now Pat. No. 6,341, 941.

(51) Int. Cl.[7] ..... F01D 5/16

(52) U.S. Cl. ..... 416/190; 416/191; 416/193 R; 416/212 A

(58) Field of Search ..... 415/119; 416/190, 416/191, 193 A, 212 A, 500, 195, 196 R

(56) References Cited

U.S. PATENT DOCUMENTS

| | | | | | |
|---|---|---|---|---|---|
| 2,278,041 | A | * | 3/1942 | Allen | 416/191 |
| 2,772,854 | A | | 12/1956 | Anxionnaz | |
| 3,719,432 | A | * | 3/1973 | Musick et al. | 416/190 |
| 3,795,462 | A | * | 3/1974 | Trumpler, Jr. | 416/196 R |
| 3,837,761 | A | | 9/1974 | Brown | |
| 4,326,836 | A | * | 4/1982 | Fitton | 416/196 R |
| 4,722,668 | A | | 2/1988 | Novacek | |
| 6,341,941 | B1 | * | 1/2002 | Namura et al. | 416/190 |

FOREIGN PATENT DOCUMENTS

| | | |
|---|---|---|
| JP | 4-5402 | 1/1992 |

* cited by examiner

*Primary Examiner*—Ninh H. Nguyen
(74) *Attorney, Agent, or Firm*—Mattingly, Stanger & Malur, P.C.

(57) ABSTRACT

The moving blades of a rotor included in a steam turbine are formed so that the width of a gap between opposite end surfaces of first connecting members of adjacent blades along the direction of rotation of the rotor and the width of a gap between opposite end surfaces of second connecting members of the adjacent blades along the direction of rotation of the rotor are determined so as to make the second connecting members start coming into contact with each other at a rotating speed of the rotor higher than a rotating speed at which the first connecting members of the adjacent blades start to come into contact with each other.

10 Claims, 9 Drawing Sheets

STEAM TURBINE

This is a divisional application of U.S. Serial No. 09/485,444, filed Feb. 11, 2000 which was the national Stage of International application no. PCT/JP97/03130 filed Sep. 5, 1997.

TECHNICAL FIELD

The present invention relates to a steam turbine provided with moving blades having twisted blades twisted about their longitudinal axes and, more particularly, to a steam turbine for use in a thermal or nuclear power plant.

BACKGROUND ART

Generally, moving blades included in a steam turbine are caused to vibrate constantly at frequencies in a wide frequency range by streams and their turbulent components of the working fluid (steam). The vibratory response of a blade structure to those excitations is greatly dependent on the respective natural frequencies in each mode of vibration and the magnitude of damping force.

Connecting members called integral covers or integral shrouds are disposed on the tips of the blades, and the connecting members disposed on the tips of the adjacent blades are connected by the blade untwisting effect of centrifugal force that acts on the moving blades when the turbine rotor rotates to bind the tips of the moving blades, because additional effects in enhancing the rigidity of the blade structure and damping vibrations can be expected from the binding of the tips of the moving blades. Thus, resonance in a low-order vibration mode in which resonance response is high can be suppressed and the reliability concerning resonance in a high-order vibration mode in which resonance response is low can be improved.

A moving blade as long as 32 in. or above, such as the moving blade of the last stage in the low-pressure section of a steam turbine, vibrates in a large amplitude. Consequently, an excessively high local stress is induced around a connecting portion of the tip portion of the moving blade or in a base portion of the moving blade, and the stressed portion is damaged. Connecting members called tie bosses or integral snubbers are disposed on middle portions of the front and the back side of each of blades, and the connecting members disposed on the middle portions of the adjacent blades are connected by using the untwisting effect to bind the middle portions of the blades in addition to binding the tips of the blades for relieving stress concentration and suppressing excessive stress generation.

A known technique disclosed in JP-A No. Hei 4-5402 provides moving blades provided with integral shrouds disposed on the tips of blades with the adjacent integral shrouds in surface-contact with each other, and integral snubbers having a cut angle substantially equal to that of the contact surfaces of the integral shrouds and disposed on the front and the back sides of substantially middle portions of the blades. The integral snubbers disposed on the adjacent blades are brought into contact with each other by the untwisting effect of centrifugal force generated when the turbine wheel rotates.

In the moving blade provided with the connecting members on its tip portion and its middle portion, reaction force or pressure (reaction force per unit area) acting on the contact surface of the connecting members disposed on the tip portion, and reaction force or pressure acting on the contact surface of the connecting members disposed on the middle portion of the blade are not determined independently of the rotating speed of the rotor but they are related with each other. In order to control the reaction force or pressure of tip and middle portions to an an allowable range or below, the relation between the respective contact states of the tip portion and the middle portion, i.e., the relation between the respective shapes or types of construction of the contact surface of the tip portion and that of the middle portion, and the relation between the time of contact of the tip portion and that of the middle portion must be taken into consideration.

However, the invention disclosed in Japanese Patent Laid-open No. Hei 4-5402 does not give any consideration to the relation between the respective contact states of the tip portion and the middle portion, which may be because an object of the invention disclosed in the cited reference is simply the extinction of vibrations of secondary mode.

An object of the present invention is to provide a steam turbine provided with moving blades designed taking the relation between the respective contact states of a tip portion and a middle portion of each moving blade into consideration so as to suppress the induction of excessive stresses in the joint of the connecting member and a connecting portion of each moving blade, and having improved reliability in strength and vibration in the operation range from the start of the turbine to the rated operation thereof.

DISCLOSURE OF INVENTION

With the foregoing object in view, according to a first aspect of the present invention, a steam turbine comprises a plurality of twisted blades arranged along a direction in which a rotor rotates and twisted about their longitudinal axes, first connecting members formed in a tip portion of each blade so as to extend on back and front sides of the blade, and second connecting members disposed on back and front sides of a middle portion of each blade between a base portion and the first connecting members of each blade; wherein width of a gap along the direction of rotation of the rotor between opposite end surfaces of the first members of the adjacent blades is smaller than width of a gap along the direction of rotation of the rotor between opposite end surfaces of the second members of the adjacent blades.

According to a second aspect of the present invention, a steam turbine comprises a plurality of twisted blades arranged along a direction in which a rotor rotates and twisted about their longitudinal axes, first connecting members formed in a tip portion of each blade so as to extend on back and front sides of the blade, and second connecting members disposed on back and front sides of a middle portion of each blade between a base portion and the first connecting members of each blade; wherein width of a gap along the direction of rotation of the rotor between opposite end surfaces of the first members of the adjacent blades, and width of a gap along the direction of rotation of the rotor between opposite end surfaces of the second members of the adjacent blades are determined so that a rotating speed of the rotor at which the first connecting members of the adjacent blades come into contact is lower than a rotating speed of the rotor at which the second members of the adjacent blades come into contact.

According to a third aspect of the present invention, a steam turbine comprises a plurality of twisted blades arranged along a direction in which a rotor rotates and twisted about their longitudinal axes, first connecting members formed in a tip portion of each blade so as to extend on back and front sides of the blade, and second connecting members disposed on back and front sides of a middle portion of each blade between a base portion and the first connecting members of each blade; wherein width of a gap along the direction of rotation of the rotor between opposite end surfaces of the first members of the adjacent blades, and width of a gap along the direction of rotation of the rotor between opposite end surfaces of the second members of the adjacent blades are determined so that the frequency of natural vibration generated when the rotor rotates changes at a rotating speed not higher than the rated rotating speed of the rotor.

BEST MODE FOR CARRYING OUT THE INVENTION

A steam turbine for use in a thermal or nuclear power plant has twisted moving blades about their longitudinal axes. A centrifugal force acts on a blade portion of each of the moving blades fixed to a peripheral portion of the rotor of the steam turbine in a direction from a base end portion toward the tip of the blade when the rotor rotates. Since the blade portion is twisted, the centrifugal force generates an untwisting force acting on the blade portion. Since the cross-sectional area of the blade portion decreases from the base end toward the tip, the torsional rigidity of the cross section decreases from the base end toward the tip.

The moving blade has the following features.

First, a torsional moment applied to the tip and necessary for twisting the section of the tip through a fixed angle is very small as compared with a torsional moment applied to a middle portion between the base end and the tip and necessary to twist the section of the middle portion through the same angle. When untwist angle through which the moving blade is untwisted when the rotating speed of the rotor rises is limited to a fixed angle by connecting members disposed near the tip or a connecting member disposed in the middle portion, a moment necessary for limiting the untwisting of the tip is far smaller than a moment necessary for limiting the untwisting of the middle portion. The moment necessary for limiting the untwisting is the product of a reaction force acting on a contact surface of the connecting member and the length of an arm between points of action of the reaction forces. Therefore, reaction forces acting on the contact surfaces of the connecting member disposed near the tip of the blade are far lower than those acting on the contact surfaces of the connecting member disposed in the middle portion of the blade, that is, when limiting the untwist angle to a fixed angle, a reaction forces acting on the middle portion of the blade is higher than that acting on the tip of the blade.

Secondly, the tips are brought into contact when the rotating speed of the rotor rises and then the middle portions are brought into contact or the middle portions are brought into contact when the rotating speed of the rotor rises and then the tips are brought into contact to reduce the rate of increase of reaction forces acting on the contact surfaces of the tips that are brought into contact first or the contact surfaces of the middle portions that are brought into contact first.

Giving consideration to those features, a steam turbine highly reliable in strength and vibration can be realized by properly adjusting rotor speed at which the tips are connected and rotor speed at which the middle portions are connected.

A preferred embodiment of the present invention will be described hereinafter with reference to the accompanying drawings.

Figure 1:
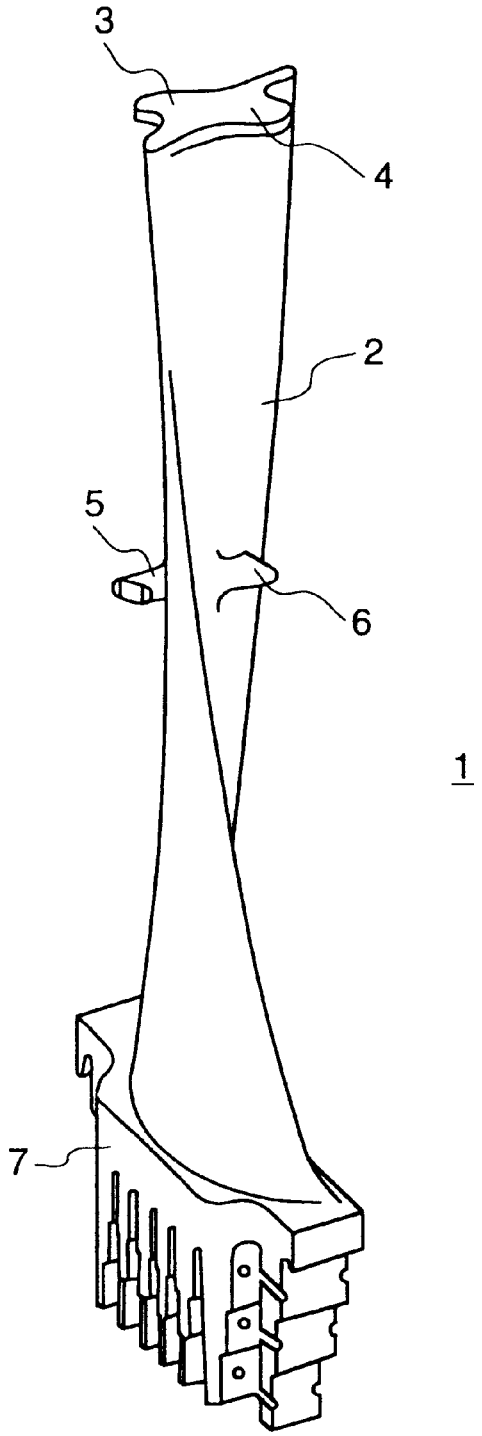
FIG. 1 is a perspective view of a moving blade of a steam turbine in accordance with the present invention.

FIG. 1 shows a moving blade included in a steam turbine in accordance with the present invention in a perspective view. Shown in FIG. 1 are a moving blade 1, a twisted blade portion 2 from a base end portion toward the tip of the blade, an integral cover 3 (back side first connecting member) disposed on the blade tip and extending backward, an integral cover (front side first connecting member) 4 disposed on the blade tip and extending forward, a tie boss (back side second connecting member) 5 projecting backward from the back side of a middle portion of the blade, a tie boss 6 (front second connecting member) 6 projecting forward from the front side of the middle portion of the blade, and a fork-shaped blade base 7. The integral covers 3 and 4, and the tie bosses 5 and 6 are formed integrally with the blade portion 2. The blade length of the blade portion 2 is 43 in. In most moving blades, the tie bosses 5 and 6 are formed in a substantially middle portion of the blade (portion at a distance equal to ½ of the blade length). The tie bosses 5 and 6 may be formed in a portion on the side of the tip with respect to the middle portion or in a portion on the side of the base end with respect to the middle portion according to the torsional rigidity of the blade portion. In most moving blades, the tie bosses 5 and 6 are formed at a substantially middle point on a line between the leading edge and the trailing edge of the blade and parallel to the tangential direction of rotation.

Figure 2:
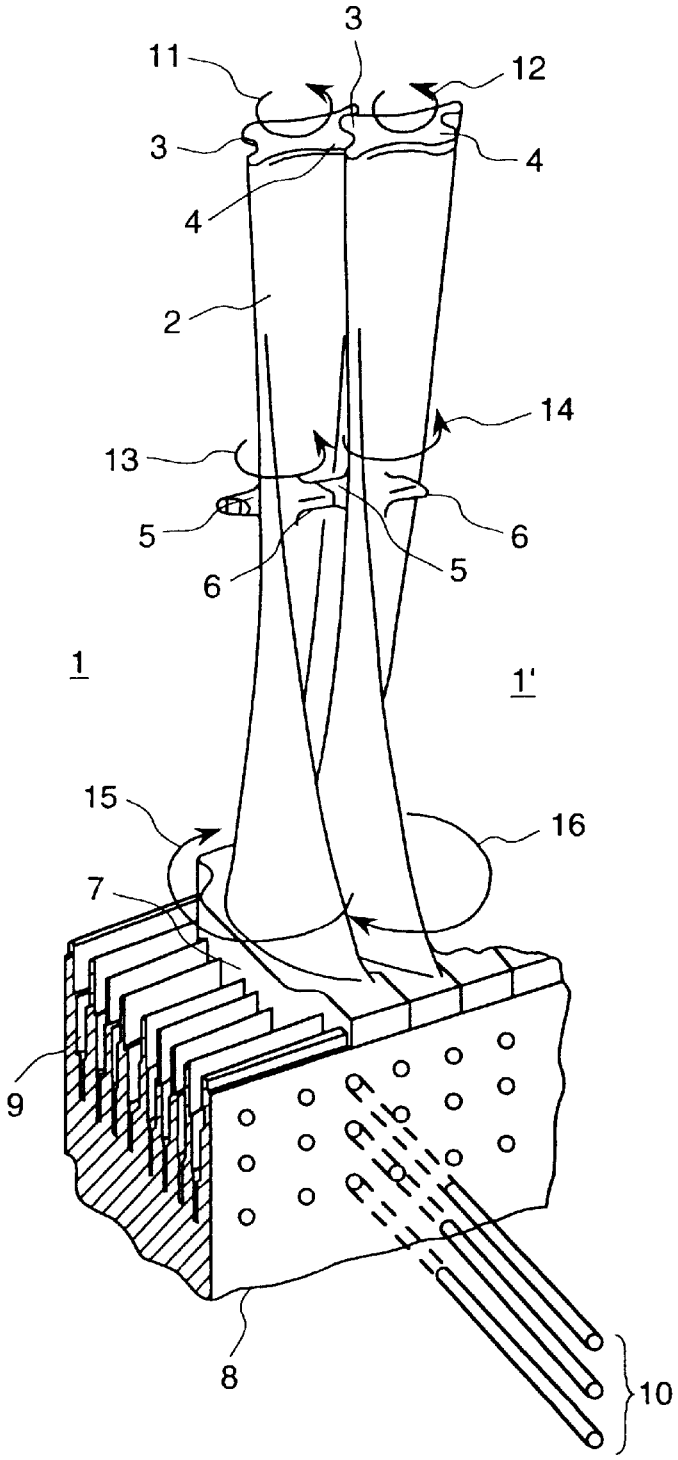
FIG. 2 is a perspective view of moving blades of a steam turbine in accordance with the present invention attached to a rotor.

FIG. 2 is a perspective view of moving blades of a steam turbine attached to a rotor. Shown in FIG. 2 are a cylindrical disk 8 fitted on the circumference of a turbine disk and provided with disk grooves 9, and pins 10 for fastening the blade base 7 to the disk 8. The blade base 7 of the moving blade 1 is fitted in the disk groves 9, and the pins 10 are inserted in holes formed in the disk 8 and the blade base 7 to fasten the moving blade 1 to the rotor. The disk 8 is formed along the circumference of the turbine disk (along a rotating direction) to arrange several tens of moving blades 1 on the circumference of the rotor. As the rotating speed of the rotor increases, centrifugal force acts in a direction from the base end toward the tip of the blade on the blade portion 2. Since the blade portion 2 is twisted, the centrifugal force attempts to untwist the blade portion 2. In FIG. 2, the arrow 11 indicates the direction of an untwisting moment acting on the tip of the moving blade 1, the arrow 12 indicates the direction of an untwisting moment acting on the tip of the moving blade 1' adjacent to the moving blade 1 with respect to a circumferential direction, the arrow 13 indicates the direction of an untwisting moment acting on the middle portion of the moving blade 1, and the arrow 14 indicates the direction of an untwisting moment acting on the middle portion of the moving blade 1'. When the untwisting actions on the tip and the middle portion of the moving blade 1 and the untwisting actions on the tip and the middle portion of the moving blade 1' are born by the integral covers and the tie bosses, torsional moments act on the blade base 7 in a direction opposite to the direction of the untwisting moments as reactions. The arrows 15 and 16 indicate the directions of the torsional moments.

Figure 3:
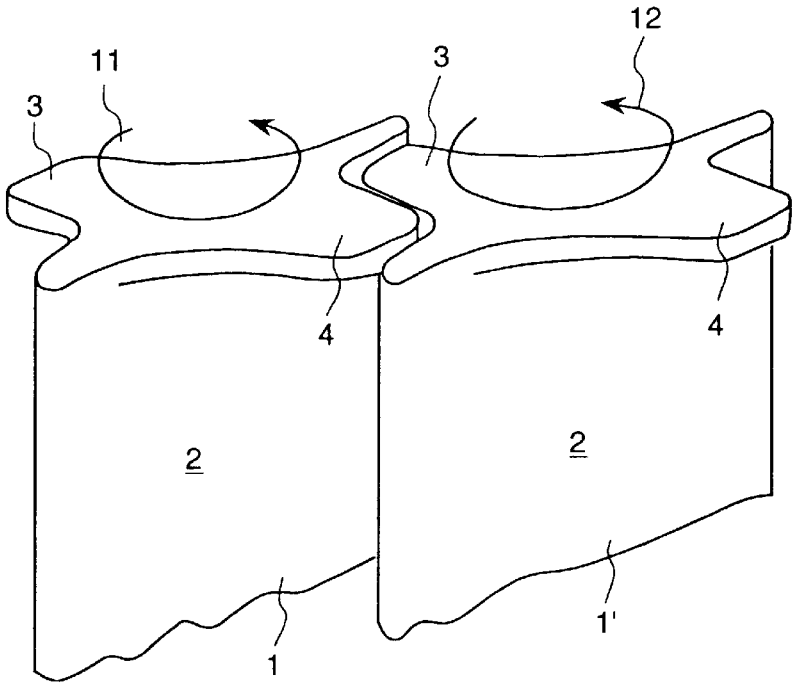
FIG. 3 is a perspective view of tip portions of adjacent moving blades of a steam turbine in accordance with the present invention.
Figure 4:
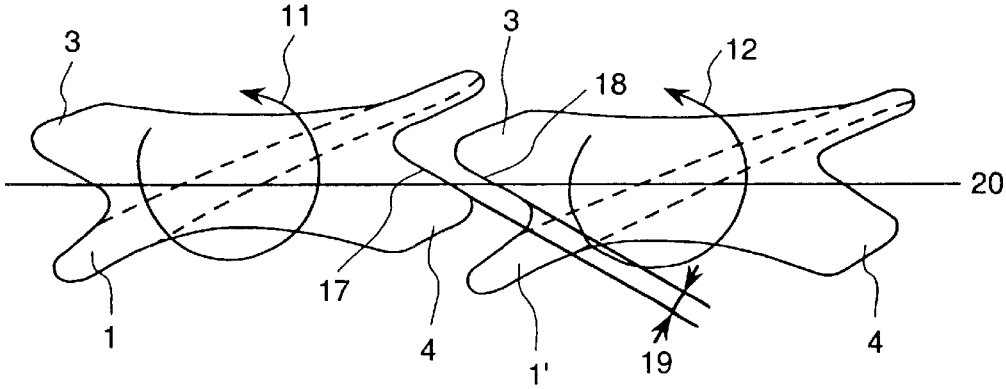
FIGS. 4 and 5 are plan views of the tip portions of the moving blades shown in FIG. 3 taken along a radial direction in FIG. 3.
Figure 5:
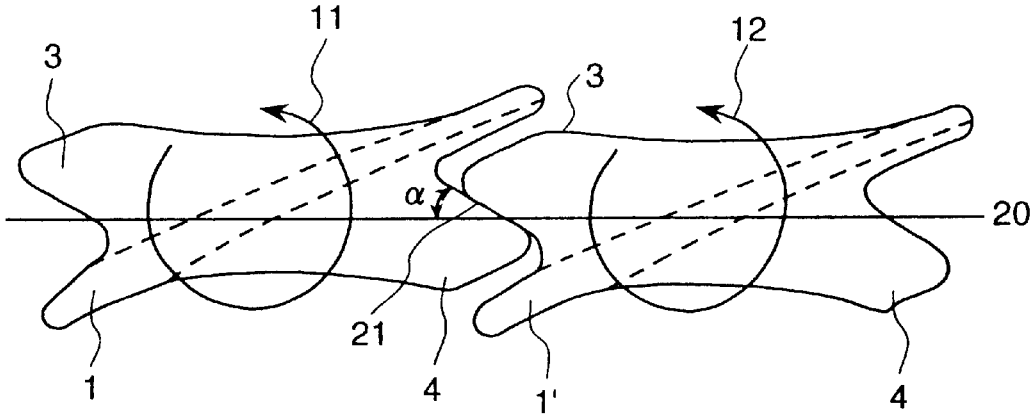

FIG. 3 is a perspective view of tip portions of the adjacent moving blades of the steam turbine in accordance with the present invention, and FIGS. 4 and 5 are plan views of the tip portions of the moving blades shown in FIG. 3 taken along a radial direction in FIG. 3. FIG. 4 shows a state of the tip portions when the rotor is stationary. FIG. 5 shows a state of the tip portions when the steam turbine is in operation under rated conditions, i.e., when the rotor is rotating at a rated rotor speed. Shown in FIGS. 3, 4 and 5 are an end surface 17 of the integral cover 4 of the moving blade 1 facing the integral cover 3 of the moving blade 1', an end surface 18 of the integral cover 3 of the moving blade 1' facing the integral cover 4 of the moving blade 1, a gap 19 showing a distance between the end surfaces 17 and 18, a circumferential line 20 extending along the circumference of the rotor (line extending in the rotating direction), a contact surface 21 in which the end surfaces 17 and 18 are in contact with each other, and an angle $\alpha$ between the circumferential line 20 and the contact surface 21. When the rotor is stationary, the gap19 is formed between the end surfaces 17 and 18. It is desirable in view of improving the rigidity of the tip portions of the blades that the gap 19 be approximately naught; that is, it is desirable that the end surfaces 17 and 18 be in point contact when the rotor is stationary. The width of the gap 19 when the rotor is stationary may be less than few millimeters to enable the end surfaces 17 and 18 come into contact with each other upon the increase of the rotating speed of the rotor to a low rotating speed immediately after the start of the rotor. As the rotating speed of the rotor rises, the untwisting moment 11 acts on the moving blade 1, the untwisting moment 12 acts on the moving blade 1', and the end surface 17 of the integral cover 4 of the moving blade 1 and the end surface 18 of the integral cover 3 of the moving blade 1' come into contact with each other in the contact surface 21, whereby the tip portions of the moving blades are restrained from untwisting. The integral covers of the moving blades adjacent to each other with respect to the circumference of the rotor come into contact with each other simultaneously with the start of rotation of the rotor or upon the increase of the rotating speed of the rotor to a very low level of several tens of rounds per minute. The integral covers of all the moving blades of the turbine wheel come into contact with the adjacent integral covers and, consequently, all the moving blades are connected.

Figure 6:
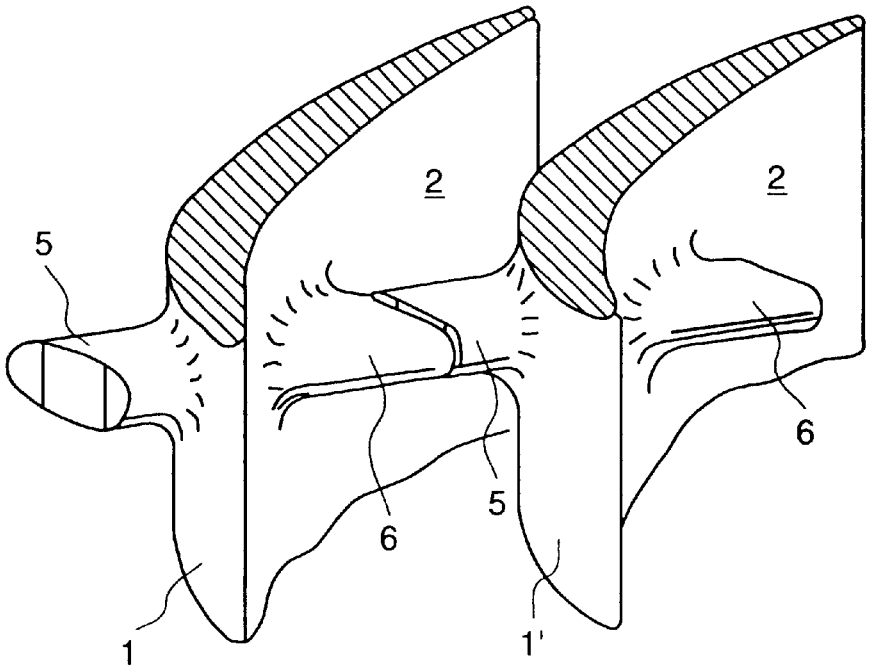
FIG. 6 is a perspective view of middle portions of adjacent moving blades of a steam turbine in accordance with the present invention.
Figure 7:
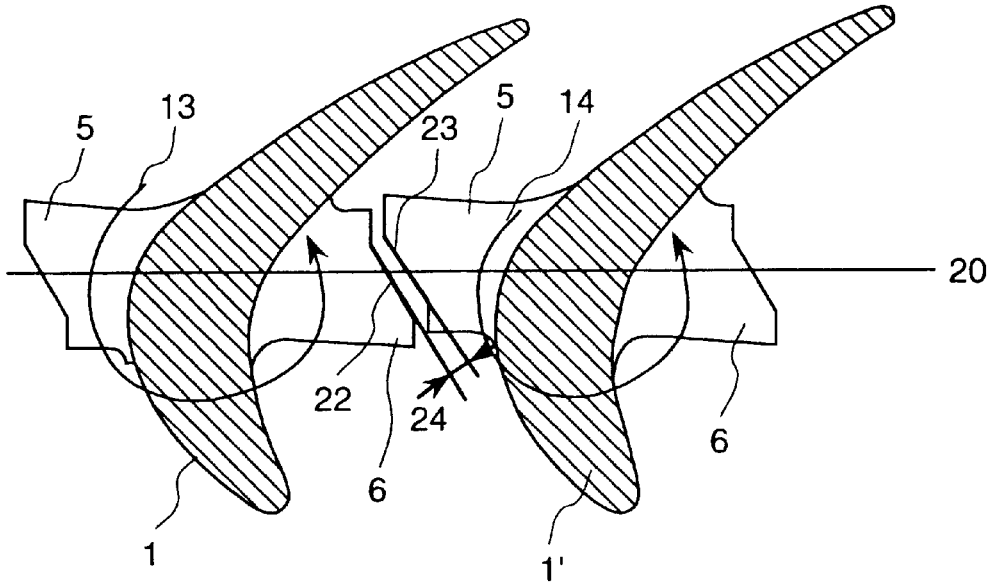
FIGS. 7 and 8 are plan views of the middle portions of the moving blades shown in FIG. 6 taken along a radial direction in FIG. 6.
Figure 8:
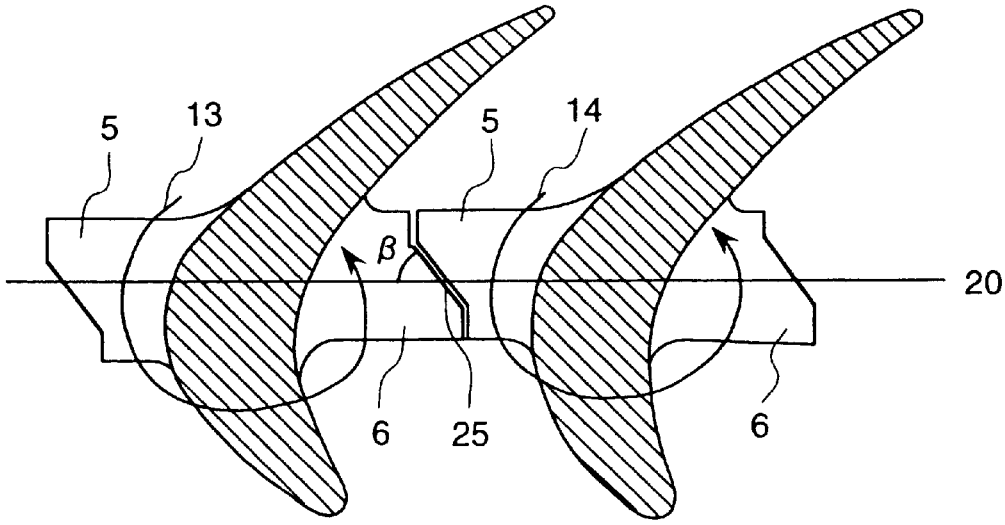

FIG. 6 is a perspective view of middle portions of the adjacent moving blades of the steam turbine in accordance with the present invention, and FIGS. 7 and 8 are plan views of the middle portions of the moving blades shown in FIG. 6 taken along a radial direction in FIG. 6. FIG. 7 shows a state of the middle portions when the rotor is stationary. FIG. 8 shows a state of the middle portions when the steam turbine is in operation under rated conditions. Shown in FIGS. 6, 7 and 8 are an end surface 22 of the tie boss 6 of the moving blade 1 facing the tie boss 5 of the moving blade 1', an end surface 23 of the tie boss 5 of the moving blade 1' facing the tie boss 6 of the moving blade 1, a gap 24 showing a distance between the end surfaces 22 and 23, a contact surface 25 in which the end surfaces 22 and 23 come into contact, and an angle $\beta$ between the circumferential line 20 extending along the circumference of the rotor and the contact surface 25. When the rotor is stationary, the gap 24 is formed between the end surfaces 22 and 23. As the rotating speed of the rotor rises, the untwisting moment 13 acts on the moving blade 1, the untwisting moment 14 acts on the moving blade 1', and the End surface 22 of the tie boss 6 of the moving blade 1 and the end surface 23 of the tie boss 5 of the moving blade 1' come into contact with each other in the contact surface 25, whereby the middle portions of the moving blades are restrained from untwisting.

The tip portions (the integral covers) come into contact with each other and are connected, and the middle portions (the tie bosses) come into contact with each other and are connected due to the untwisting force acting as the rotating speed of the rotor rises. Consequently, the tip portions and the middle portions are restrained from untwisting, and reaction forces acting on the contact surfaces 21 and 25 increase with the increase of the rotating speed of the rotor. Similarly, surface pressures (reaction forces per unit area) acting on the contact surfaces increase with the increase of the rotating speed of the rotor. If the reaction forces or the surface pressures increase excessively beyond an allowable value, an excessive stress is induced in the joint of the blade portion 2 and the integral cover 3 or 4, the joint of the blade portion 2 and the tie boss 5 or 6, or the blade base 7, and the joint or the blade base 7 is damaged when the stress exceeds an allowable value. Accordingly, it is important to adjust properly a rotating speed of the rotor at which the integral covers come into contact with each other and the tie bosses come into contact with each other.

Figure 9:
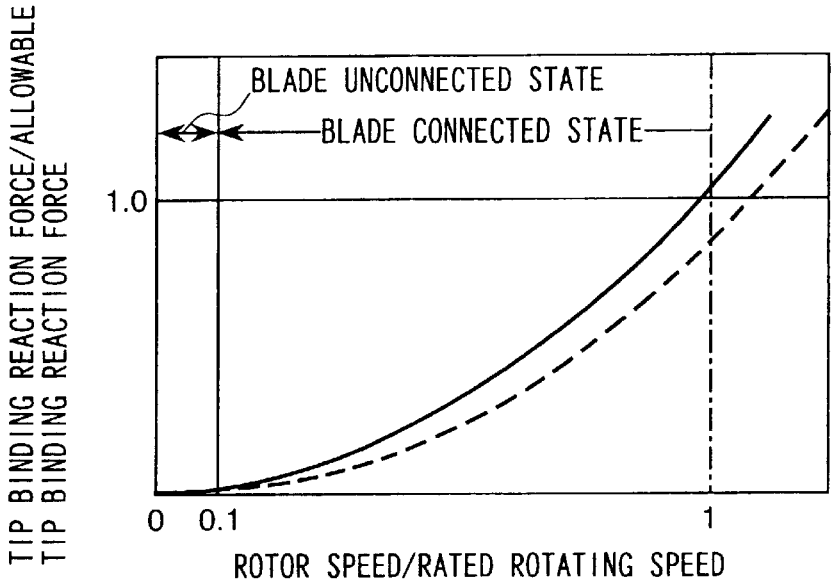
FIG. 9 is a graph showing the dependence of middle portion binding reaction force on rotor speed.

FIG. 9 is a graph showing the dependence of tip binding reaction force that acts on the contact surface of the integral cover of the moving blade not provided with the tie bosses on rotor speed. In FIG. 9, tip binding reaction force is represented by dimensionless values obtained by dividing tip binding reaction forces by an allowable tip binding reaction force that does not cause damage in the blade (hereinafter referred to as "allowable tip binding reaction force"). Similarly, rotor speeds are converted into dimensionless values by using the rated rotating speed of the rotor. The rated rotating speed of the steam turbine in a thermal power plant is 3000 rpm for 50 Hz electric power, and is 3600 rpm for 60 Hz electric power. In FIG. 9, a continuous line indicates the variation of the normalized tip binding reaction force when the width of the gap 19 between the end surfaces of the adjacent integral covers is naught in a state where the rotor is stationary, and a broken line indicates the variation of the normalized tip binding reaction force when the width of the gap 19 between the end surfaces of the adjacent integral covers is less than few millimeters in a state where the rotor is stationary. When the gap 19 between the end surfaces of the adjacent integral covers is naught, the tip binding reaction force is generated simultaneously with the start of rotation of the rotor, increases as the rotating speed of the rotor rises, and exceeds the allowable tip binding reaction force before the rotating speed of the rotor exceeds the rated rotating speed. When the gap 19 between the end surfaces of the adjacent integral covers is about few millimeters, since any tip binding reaction force is not generated until the rotating speed of the rotor reaches a certain value, the tip binding reaction force increasing with the increase of the rotating speed of the rotor does not exceed the allowable tip binding reaction force when the rotating speed of the rotor is equal to the rated rotating speed. If the width of the gap 19 between the end surfaces of the adjacent integral covers is excessively wide, the adjacent blades are not connected in a wide operation range. Consequently, a vibration attenuating effect provided by binding together the tip portions cannot be expected and vibration stress increases.

Figure 10:
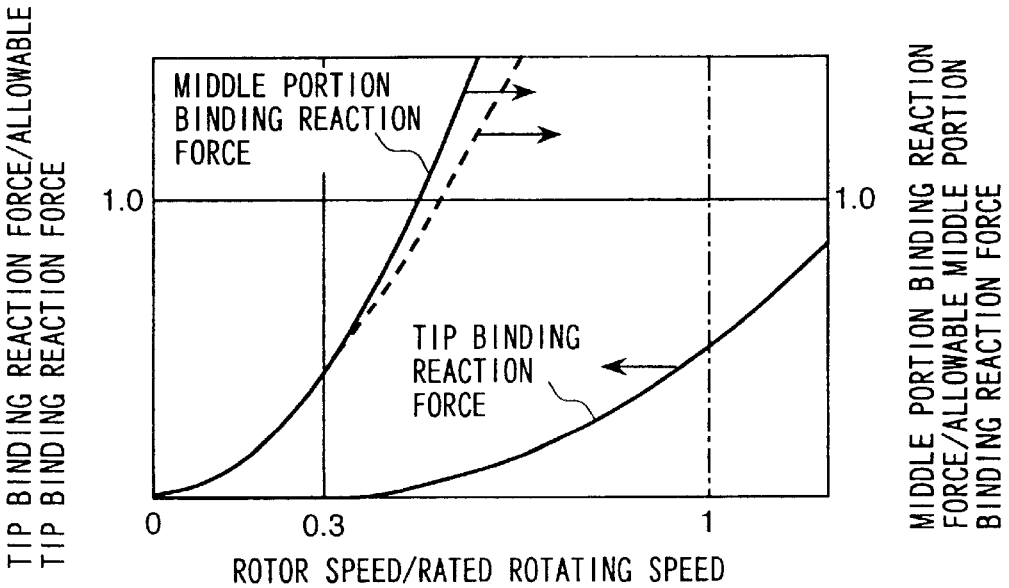
FIG. 10 is a graph showing the dependence of tip binding reaction force and middle portion binding reaction force on rotor speed.

FIG. 10 shows the dependence of middle portion binding reaction force that acts on the contact surface of the tie bosses on rotor speed when the blades are not provided with the integral covers. As mentioned above, the torsional rigidity of the base portion of the moving blade 1 is greater than that of the tip portion of the same. Therefore, the increasing rate of the middle portion binding reaction force when the moving blades are not provided with any integral covers and provided with only the tie bosses is very high as compared with that of the tip binding reaction force when the moving blades are not provided with any tie bosses. Accordingly, when the adjacent tie bosses come into contact substantially simultaneously with the start of rotation of the rotor, the middle portion binding reaction force exceeds the allowable middle portion binding reaction force when the rotor is rotating at a rotating speed far below the rated rotating speed.

FIG. 10 also shows the dependence of tip binding reaction force and middle portion binding reaction force on rotor speed when the moving blades are provided with integral covers and the tie bosses, the tie bars are formed so that the adjacent tie bosses come in contact with each other substantially simultaneously with the start of rotation of the rotor and the adjacent integral covers come into contact with each other when the rotor is rotating at a rotating speed equal to 30% of the rated rotating speed. In FIG. 10, a broken line indicates the variation of the middle portion binding reaction force after the integral covers have come into contact with each other. As mentioned above, when the rotating speed of the rotor is raised to bring the integral covers into contact first and then the tie bosses or to bring the tie bosses into contact first and then the integral covers, the rate of increase of the reaction force acting on the contact surfaces of the connecting members which are brought into contact first can be reduced. However, the rate of increase of the middle portion binding reaction force is very high as compared with that of the tip binding reaction force. Therefore, the rate of increase of the middle portion binding reaction force decreases scarcely after the integral covers have come into contact, and the middle portion binding reaction force exceeds the allowable middle portion binding reaction force before the rotating speed of the rotor reaches the rated rotating speed as shown in FIG. 10.

It is known from the foregoing facts that the effect of the integral covers on the attenuation of the vibrations of the moving blades is greater when the range of rotor speed in which the moving blades are separate from each other is narrower. Therefore, it is desirable to form the integral covers and the tie bosses so that the integral covers are in contact while the rotor is stationary or come into contact immediately after the start of rotation of the rotor, and then the tie bosses come into contact, and both the integral covers and the tie bosses are in contact so that the tip portions and the middle portions are connected, respectively, when the rotor is rotating at the rated rotating speed.

Rotor speed at which the time bosses are in contact will be described.

Figure 11:
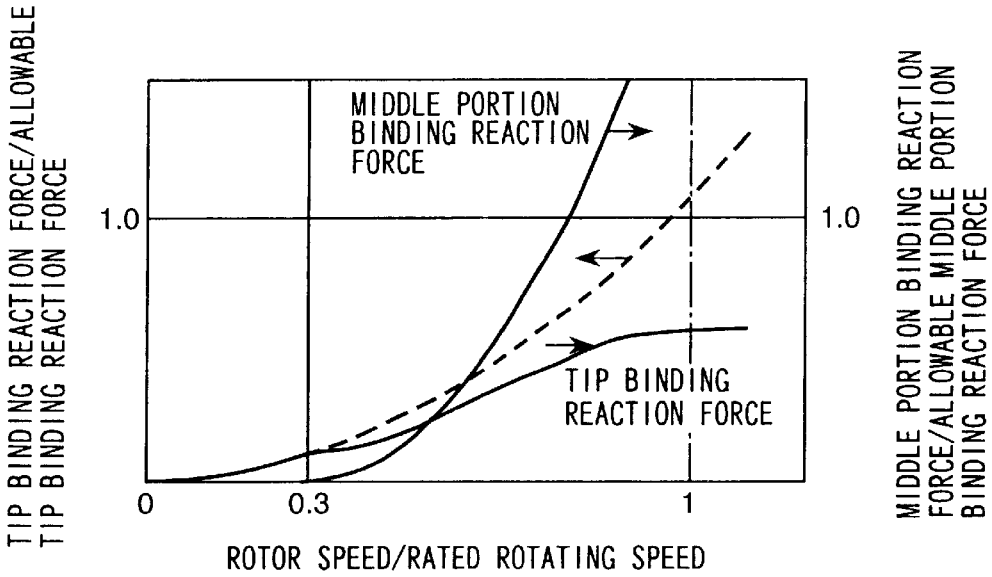
FIG. 11 is a graph showing the dependence of tip binding reaction force and middle portion binding reaction force on rotor speed.

FIG. 11 shows the dependence of tip binding reaction force and middle portion binding reaction force on rotor speed when the integral covers come into contact substantially simultaneously with the start of rotation of the rotor, and the tie bosses come into contact when the rotor rotates at a rotating speed equal to about 30% of the rated rotating speed. It is known from FIG. 11 that the rate of increase of the tip binding reaction force after the tie bosses have come into contact is lower than the rate of increase of the tip binding reaction force before the tie bosses come into contact. Therefore, the tip binding reaction force does not exceed the allowable tip binding reaction force when the rotor rotates at the rated rotating speed or at a rotating speed in a rotating speed range beyond the rated rotating speed. However, since the rate of increase of the middle portion binding reaction force is high, the middle portion binding reaction force exceeds the allowable middle portion binding reaction force before the rotating speed reaches the rated rotating speed. Therefore, the gap between the adjacent tie bosses are adjusted so that the tie bosses come into contact when the rotor rotates at a rotating speed greater than 30% of the rated rotating speed, for example, at a rotating speed equal to 70% of the rated rotating speed.

Figure 12:
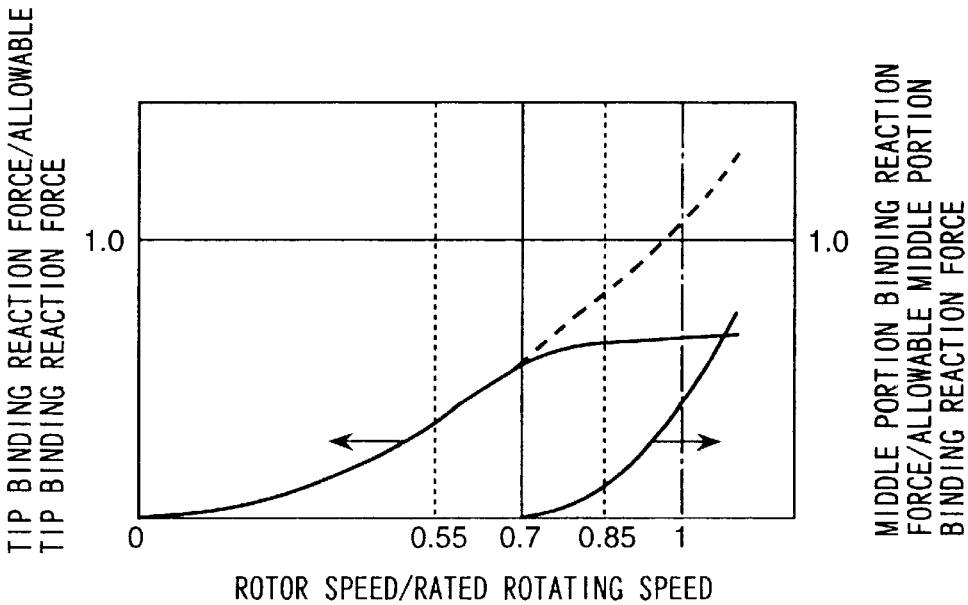
FIG. 12 is a graph showing the dependence of tip binding reaction force and middle portion binding reaction force on rotor speed.

FIG. 12 shows the dependence of tip binding reaction force and middle portion binding reaction force on rotor speed when the integral covers come into contact substantially simultaneously with the start of rotation of the rotor and the tie bosses come into contact when the rotor rotates at a rotating speed equal to 70% of the rated rotating speed. Since the rate of increase of the tip binding reaction force after the tie bosses have come into contact is lower than that before the tie bosses come into contact as shown in FIG. 12, the tip binding reaction force does not exceed the allowable tip binding reaction force when the rotor rotates at the rated rotating speed and even when the rotor is rotating at a rotating speed in a rotating speed range beyond the rated rotating speed. Since the middle portion binding reaction force becomes effective when the rotating speed of the rotor is high, the middle portion binding reaction force does not exceed the allowable middle binding reaction force when the rotor rotates at the rated rotating speed and even when the rotor rotates at a rotating speed in a rotating speed range beyond the rated rotating speed.

Figure 13:
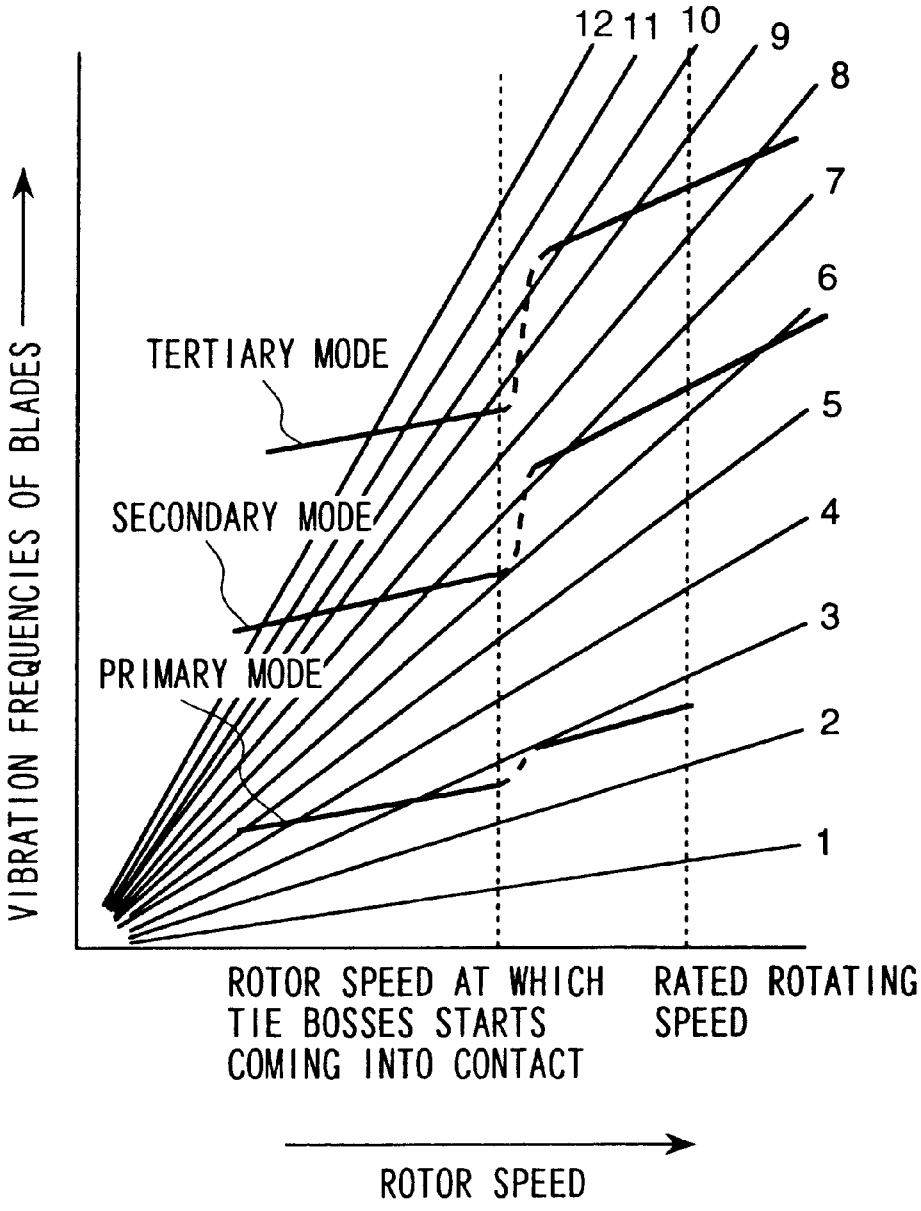
FIG. 13 is a graph showing the dependence of the vibration frequencies of blades on rotor speed.

The operation of the present invention will be explained in terms of the vibration characteristic of the blade. FIG. 13 shows the dependence of the natural vibration frequencies (hereinafter referred to as "blade vibration frequencies") of all the blades on rotor speed when the integral covers come into contact substantially simultaneously with the start of rotation of the rotor and the tie bosses come into contact when the rotating speed of the rotor is equal to 70% of the rated rotating speed. FIG. 13 shows the drawing which is called Campbell diagram. In FIG. 13, thick continuous lines indicate blade vibration characteristics in a primary mode, a secondary mode and a tertiary mode. Dotted lines on the thick lines indicate transition regions of the blade vibration characteristics. The transition region corresponds to a state where some of the tie bosses arranged along the circumference are in contact and the rest are not in contact. Fine continuous lines indicate the frequencies of exciting force of the steam turbine equal to integral multiples (1, 2, 3, . . . ) of the rotation frequency of the rotor (hereinafter referred to as "excitation frequencies"). Suppose that the rotation frequency of the rotor corresponding to the rated rotating speed is 50 Hz. Then, an excitation frequency equal to one time the rotation frequency is 50 Hz, and an excitation frequency equal to twice the rotation frequency is 100 Hz. Each of the intersections of the thick and the fine continuous lines corresponds to a resonant point between the blade frequency and the excitation frequency of the steam turbine. Since the amplitude of vibration of the blade increases remarkably at the resonant point due to resonance, the steam turbine is designed so that the rated rotating speed does not coincide with the resonant point. The smaller the ratio of the excitation frequency to the rotation frequency of the rotor (the lower the excitation frequency), the greater is the amplification of the amplitude of the vibration of the blade. As obvious from FIG. 13, the vibration characteristic of the blade changes sharply when the rotating speed of the rotor in a range around the rotating speed of the rotor at which the tie bosses come into contact; that is, the vibration frequency of the blade increases sharply immediately after the tie bosses have come into contact, because the general torsional rigidity of the blade increases greatly when the tie bosses come into contact to connect the middle portions of the blades. A phenomenon in which an external force (reaction force) starts acting suddenly at a certain time point (rotor speed) is called a transient phenomenon. When the blade vibration frequency is high relative to the rotor speed, the excitation frequency at the resonant point is high and hence the strength of the blade resisting vibrations and the reliability of the moving blade are improved. For example, even if resonance occurs while the rotor is rotating at the rated rotating speed, the amplitude of vibration of the blade does not rise greatly because the excitation frequency is high.

The rotating speed of the rotor at which the tie bosses start coming into contact in order that the reaction force acting on the contact surfaces of the integral covers is below the allowable value and the reaction acting on the contact surfaces of the tie bosses is below the allowable value is not fixed at the rotation speed equal to 70% of the rated rotating speed. Generally, the greater the length of the blade, the lower the torsional rigidity of the blade portion 2 or the higher the rotating speed of the rotor, the greater is the reaction force. For example, in a long blade of 32 inches or above in blade length for use in a steam turbine having a medium or large capacity ratio, the reaction force acting on the contact surface of the tie bosses can be limited to a value not greater than the allowable value, provided that the rotating speed of the rotor at which the tie bosses start coming into contact is about 55% or more of the rated rotating speed or above.

Basically, the upper limit of the range of the rotating speed of the rotor in which the tie bosses must start coming into contact may be the rated rotating speed or below; that is, it is satisfactory when the tie bosses of all the blades of the turbine wheel are in contact at least when the steam turbine is in a rated operation. However, as mentioned above, all the blades of the turbine wheel do not start coming into contact with the adjacent ones simultaneously at a rotating speed of the rotor, and the contact of all the blades with the adjacent ones is completed in a certain range of rotating speed (transient region), which is due to unavoidable differences in manufacturing processes or in steam turbine assembling processes. When the tie bosses come into contact, the rigidity of the middle portion of the blade changes sharply and hence the natural frequency and the vibration mode of the blade change greatly. The stabilization of the transient characteristic of the blade takes time. From the foregoing facts, it is desirable that the tie bosses start coming into contact with the adjacent ones when the rotating speed of the rotor is at least not higher than 85% of the rated rotating speed to ensure that the tie bosses of all the blades on the turbine wheel complete coming into contact with the adjacent ones before the rotating speed of the rotor reaches the rated rotating speed and the vibration characteristic stabilizes.

The untwist angle of the blade portion 2 is dependent on ① blade length, ② torsional rigidity of the blade portion 2, and ③ rotating speed of the rotor. The greater the blade length, the lower the torsional rigidity of the blade portion 2 or the higher the rotating speed of the rotor, the greater is the untwist angle. Therefore, the rotating speed of the rotor at which the connecting members start coming into contact can be adjusted by adjusting the distance along a circumferential direction of the rotor (rotating direction) between the connecting member on the front side of the moving blade 1 and the connecting member on the back side of the moving blade 1'. That is, the rotating speed of the rotor at which the integral covers start coming into contact can be adjusted by adjusting the gap 19 between the end surfaces of the integral covers of the adjacent moving blades and the angle $\alpha$, and the rotating speed of the rotor at which the tie bosses start coming into contact can be adjusted by adjusting the gap 24 between the end surfaces of the tie bosses of the adjacent moving blades and the angle $\beta$.

The width of the gap 19 between the end surfaces of the integral covers of the adjacent moving blades is adjusted to naught or a small value less than few millimeters to enable the integral covers to come into contact with each other substantially simultaneously with the start of rotation of the rotor. The gap 24 between the end surfaces of the tie bosses of the adjacent moving blades is formed in a width greater than that of the gap 19 between the end surfaces of the integral covers to make the tie bosses come into contact after the integral covers have come into contact.

The untwist angle necessary for reducing the gap completely to naught is dependent on the angle between the circumferential direction line of the rotor and the contact surface of the connecting members, namely, the angle $\alpha$ or the angle $\beta$. When sections of the blade are turned about the longitudinal axis of the blade in untwisting the blade, the smaller the angle between the circumferential direction line and the contact surface of the connecting members, the smaller is the angle of turning necessary to reduce the width of the gap to naught. Therefore, the angle $\beta$ relating with the contact surface of the tie bosses is greater than the angle $\alpha$ of the contact surface of the integral covers. Desirably, the design angle $\alpha$ relating with the integral covers is in the range of 25° to 50°. It is desirable that a compressive stress rather than a bending stress is induced in the tie bosses from the view point of strength. That is, it is desirable that the direction of action of the reaction force is parallel to the circumferential direction of the rotor ($\beta$=90°). Therefore, it is desirable that the angle $\beta$ relating with the contact surface of the tie bosses is in the range of 45° to 90°.

A joint structure joining together the moving blade 1 and the disk 8 will be described hereinafter.

Torsional moments 15 and 16 act on the blade bases 7 as shown in FIG. 2, when the blade portions are restrained from untwisting by the connecting members. For example, in a blade embedding structure of an inverted Christmas tree type mentioned in Japanese Patent Laid-open No. Hei 4-5402, a blade base is forced to be in partial contact with walls defining a disk groove by a torsional moment and an excessive stress is induced locally in the blade base or the walls defining the disk groove when the rotating speed of the rotor is high. In the steam turbine of the present invention, the blade base 7 of a fork type is fitted in the disk grooves 9 formed in a direction parallel to the circumference of the rotor, and the blade base 7 and the walls defining the disk grooves 9 are fastened firmly together with the pins 10. Therefore, partial contact of the blade base 7 with the walls defining the disk grooves 9 can be prevented even if a torsional moment acts on the blade base and, consequently, the induction of a local excessive stress in the moving blade 1 and the disk 8 can be suppressed.

Figure 14:
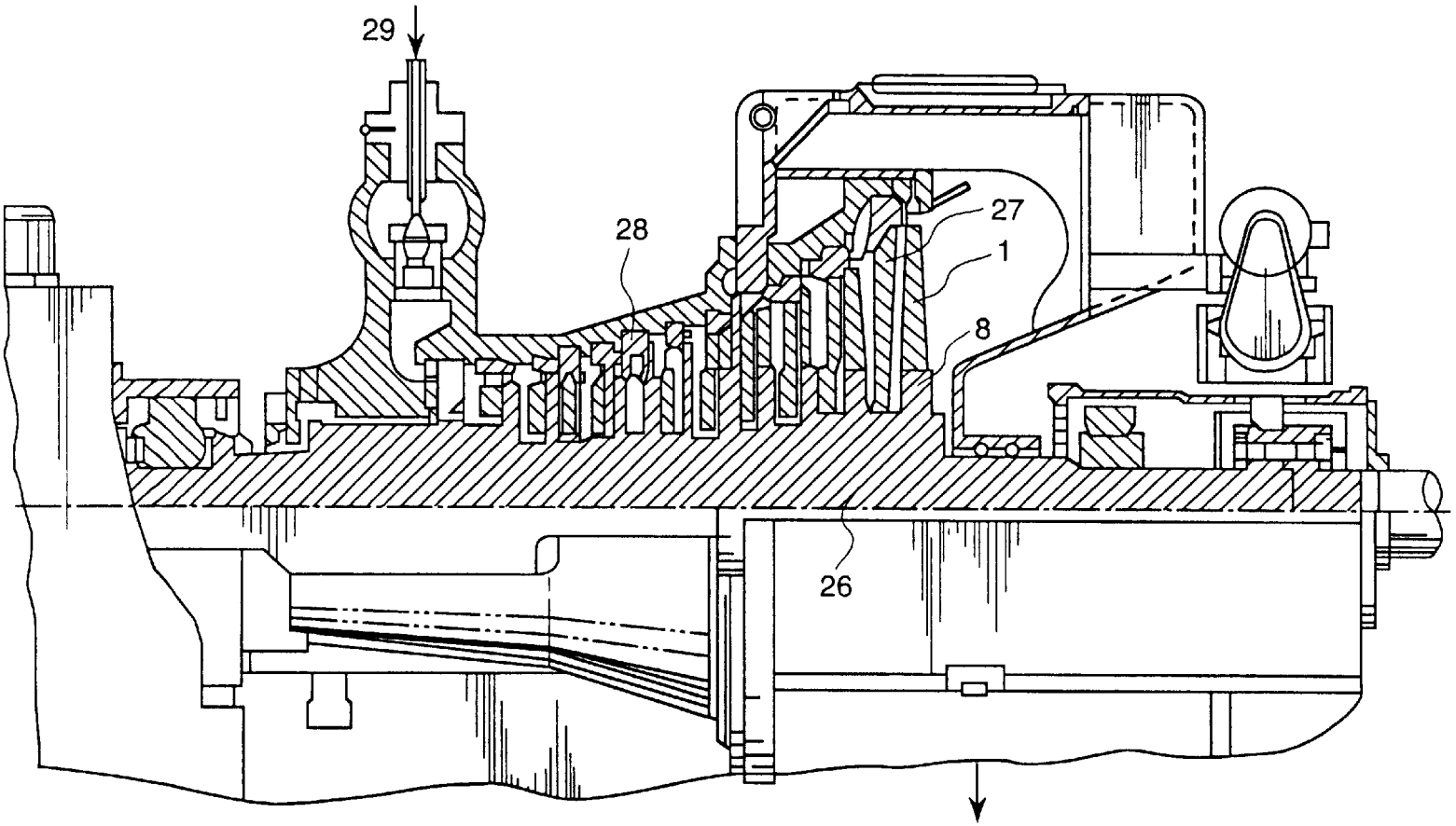
FIG. 14 is a fragmentary longitudinal sectional view of a steam turbine in accordance with the present invention.

FIG. 14 shows the mechanical construction of the steam turbine in accordance with the present invention. This steam turbine is intended for use in a thermal power plant. Shown in FIG. 14 are a rotor 26, stationary blades (nozzle blades) 27, an outer casing 28 and main steam 29. The rotor 26 is provided on its circumference with several tens of moving blades 1 on each of circles. A set of the moving blades arranged on one circle will be referred to as a "stage" hereinafter. A plurality of stages are arranged axially to form the rotor 26. Main steam 29 supplied from a steam generator is guided by the stationary blades 27 arranged on the outer casing 28 toward the moving blades 1 of the rotor 26 to drive the rotor 26 for rotation. A power generator is connected to one end of the rotor 26 to convert the mechanical energy of the rotating rotor into electric energy for power generation. In this steam turbine, the moving blades of the lower stages with respect to the flowing direction of steam have longer blade length; that is, the blade length of the moving blades 1 of the last stage nearest to a steam condenser is the greatest. Therefore conditions concerning strength and vibration for the moving blades 1 of the last stage are the severest. The blade length of the moving blades of the last stage of a low-pressure turbine used in a thermal power plant is in the range of about 32 inches to about 50 inches. In the steam turbine of the present invention, the moving blades 1 of the last stage and those of the preceding stage of the last stage are provided with integral covers and tie bosses. The moving blades 1 of the rest of the stages are not provided with tie bosses and are provided with only integral covers.

In the steam turbine of the present invention, the blade portions are provided with the connecting members and the adjacent blades are connected when the rotor rotates by an untwisting force generated when the rotor rotates at an elevated rotating speed. Consequently, the rigidity of the blade portions is improved and vibrations of the blade portions are attenuated. The connecting members disposed in the tip portions and the middle portions of the blades limit the untwisting of the blades, so that reaction forces acting on the contact surfaces of the connecting members can be distributed, whereby the induction of an excessive stress in the joints of the blade portions and the connecting members can be suppressed. Since the middle portions of the blades are connected, after the tip portions of the blades have been connected, at a rotating speed or the rotor higher than that of the rotor at which the tip portions of the blade are connected, i.e., the middle portions of the blades in which reaction force increases at a high rate with the increase of the rotating speed of the rotor are connected after the tip portions have been connected, both the reaction force acting on the contact surface of the tip portions of the blades and the reaction force acting on the middle portions of the blades can be limited to values below allowable values. Therefore, the induction of an excessive stress in the joints of the connecting members and the blades can be suppressed even under a difficult condition where the blades have a great blade length and the rotor rotates at a high rotating speed.

In the steam turbine in accordance with the present invention, the blade base of a fork type is fitted in the disk grooves formed in a direction parallel to the circumference of the rotor. Therefore, partial contact of the blade base with the walls defining the disk grooves can be prevented even if a torsional moment acts on the blade base and, consequently, the induction of a local excessive stress can be suppressed.

In the foregoing steam turbine embodying the present invention, the moving blade is provided with only one set of the tie bosses on the front and the back sides of its middle portion. The moving blade may be provided with a plurality of sets (two sets, three sets, . . . ) of tie bosses for the same effect. If each of the moving blades is provided with a plurality of sets of tie bosses, the tie bosses are disposed so that the integral covers come into contact first, and then the sets of tie bosses come sequentially into contact from those nearer to the integral covers. A rotating speed of the rotor at which the each set of tie bosses come into contact with that of the adjacent moving blade is dependent on the position of the tie bosses with respect to the blade length and the torsional rigidity of a portion of the blade corresponding to the tie bosses. From the view point of strength, in some cases, it is possible to make the integral covers or the tie bosses disposed in the tip portion of the blade, and the tie bosses disposed in the base portion of the blade come simultaneously (at the same rotating speed of the rotor) into contact. In some cases, the plurality of sets of tie bosses may start coming into contact at any rotating speed of the rotor, provided that the integral covers come into contact first.

What is claimed is:

1. Turbine blades for a steam turbine comprising:

a plurality of twisted blades arranged along a direction in which a rotor of the steam turbine rotates and twisted about their longitudinal axes;

first connecting members formed in a tip portion of each twisted blade so as to extend on back and front sides of the twisted blade; and second connecting members disposed on back and front sides of a middle portion of each twisted blade between a base portion and the first connecting members of each twisted blade; and wherein said turbine blades are formed so that a width of a gap along the direction of rotation of the rotor between opposite end surfaces of the first members of adjacent twisted blades is smaller than a width of a gap along the direction of rotation of the rotor between opposite end surfaces of the second members of the adjacent twisted blades.

2. Turbine blades for a steam turbine comprising:

a plurality of twisted blades arranged along a direction in which a rotor of the steam turbine rotates and twisted about their longitudinal axes;

first connecting members formed in a tip portion of each twisted blade so as to extend on back and front sides of the twisted blade; and second connecting members disposed on back and front sides of a middle portion of each twisted blade between a base portion and the first connecting members of each twisted blade; and wherein said turbine blades are formed so that a distance between opposite end surfaces of the first connecting members of the adjacent twisted blades is shorter than a distance between opposite end surfaces of the second connecting members of the adjacent twisted blades.

3. Turbine blades for a steam turbine comprising:

a plurality of twisted blades arranged along a direction in which a rotor of the steam turbine rotates and twisted about their longitudinal axes;

first connecting members formed in a tip portion of each twisted blade so as to extend on back and front sides of the twisted blade; and second connecting members disposed on back and front sides of a middle portion of each twisted blade between a base portion and the first connecting members of each twisted blade; and wherein said turbine blades are formed so that an angle between an end surface of the first connecting member extending on the back side of the twisted blade, facing the first connecting member of an adjacent twisted blade and the direction of rotation of the rotor is smaller than an angle between an end surface of the second connecting member extending on the back side of the twisted blade, facing the second connecting member of the adjacent twisted blade and the direction of rotation of the rotor.

4. Turbine blades for a steam turbine comprising:

a plurality of twisted blades arranged along a direction in which a rotor of the steam turbine rotates and twisted about their longitudinal axes;

first connecting members formed in a tip portion of each twisted blade so as to extend on back and front sides of the twisted blade; and second connecting members disposed on back and front sides of a middle portion of each twisted blade between a base portion and the first connecting members of each twisted blade; and wherein said turbine blades are formed so that an angle between an end surface of the first connecting member extending on the front side of the twisted blade, facing the first connecting member of an adjacent twisted blade and the direction of rotation of the rotor is smaller than an angle between an end surface of the second connecting member extending on the front side of the twisted blade, facing the second connecting member of the adjacent twisted blade and the direction of rotation of the rotor.

5. Turbine blades for a steam turbine comprising:

a plurality of twisted blades arranged along a direction in which a rotor of the steam turbine rotates and twisted about their longitudinal axes;

first connecting members formed in a tip portion of each twisted blade so as to extend on back and front sides of the twisted blade; and second connecting members disposed on back and front sides of a middle portion of each twisted blade between a base portion and the first connecting members of each twisted blade; and wherein said turbine blades are formed so that an angle between a contact surface in which end surfaces of the first connecting members of adjacent twisted blades come into contact with each other and the direction of rotation of the rotor is smaller than an angle between a contact surface in which end surfaces of the second connecting members of the adjacent twisted blades come into contact with each other and the direction of rotation of the rotor.

6. Turbine blades for a steam turbine comprising:

a plurality of twisted blades arranged along a direction in which a rotor of the steam turbine rotates and twisted about their longitudinal axes;

first connecting members formed in a tip portion of each twisted blade so as to extend on back and front sides of the twisted blade; and second connecting members disposed on back and front sides of a middle portion of each twisted blade between a base portion and the first connecting members of each twisted blade; and wherein said turbine blades are formed so that a width of a gap between opposite end surfaces of the first connecting members of adjacent twisted blades along the direction of rotation of the rotor and a width of a gap between opposite end surfaces of the second connecting members of the adjacent twisted blades along the direction of rotation of the rotor are determined so as to make the second connecting members start coming into contact with each other at a rotating speed of the rotor higher than a rotating sped at which the first connecting members of the adjacent twisted blades start coming into contact with each other.

7. Turbine blades for a steam turbine comprising:

a plurality of twisted blades arranged along a direction in which a rotor of the steam turbine rotates and twisted about their longitudinal axes;

first connecting members formed in a tip portion of each twisted blade so as to extend on back and front sides of the twisted blade; and second connecting members disposed on back and front sides of a middle portion of each twisted blade between a base portion and the first connecting members of each twisted blade; and wherein said turbine blades are formed so that a width of a gap between opposite end surfaces of the first connecting members of adjacent twisted blades along the direction of rotation of the rotor and a width of a gap between opposite end surfaces of the second connecting members of the adjacent twisted blades along the direction of rotation of the rotor are determined so as to make the first connecting members of the adjacent twisted blades come into contact with each other and the second connecting members of the adjacent twisted blades be not in contact with each other when the rotor rotates at a rotating speed not higher than a rated rotating speed of the rotor, and to make both the first and the second connecting members of the adjacent twisted blades be in contact with each other when the rotor rotates at the rated rotating speed.

8. Turbine blades for a steam turbine comprising:

a plurality of twisted blades arranged along a direction in which a rotor of the steam turbine rotates and twisted about their longitudinal axes;

first connecting members formed in a tip portion of each twisted blade so as to extend on back and front sides of the twisted blade; and second connecting members disposed on back and front sides of a middle portion of each twisted blade between a base portion and the first connecting members of each twisted blade; and wherein said turbine blades are formed so that a width of a gap between opposite end surfaces of the first connecting members of adjacent twisted blades along the direction of rotation of the rotor and a width of a gap between opposite end surfaces of the second connecting members of the adjacent twisted blades along the direction of rotation of the rotor are determined so as to make the first connecting members of the adjacent twisted blades be in contact with each other and the second connecting members of the adjacent twisted blades be not in contact with each other when the rotor is stationary, and to make both the first and the second connecting members of the adjacent twisted blades be in contact with each other when the rotor rotates at the rotating speed.

9. Turbine blades for a steam turbine comprising:

a plurality of twisted blades arranged along a direction in which a rotor of the steam turbine rotates and twisted about their longitudinal axes, said turbine blades vibrating at a natural frequency as the rotor rotates;

first connecting members formed in a tip portion of each twisted blade so as to extend on back and front sides of the twisted blade; and second connecting members disposed on back and front sides of a middle portion of each twisted blade between a base portion and the first connecting members of each twisted blade; and wherein said turbine blades are formed so that a width of a gap between opposite end surfaces of the first connecting members of adjacent twisted blades along the direction of rotation of the rotor and a width of a gap between opposite end surfaces of the second connecting members of the adjacent twisted blades along the direction of rotation of the rotor are determined so as to change the natural frequency when the rotor rotates at a rotating speed not higher than a rated rotating speed thereof.

10. Turbine blades for a steam turbine comprising:

a plurality of twisted blades arranged along a direction in which a rotor of the steam turbine rotates and twisted about their longitudinal axes, said turbine blades vibrating at a natural frequency;

first connecting members formed in a tip portion of each twisted blade so as to extend on back and front sides of the twisted blade; and second connecting members disposed on back and front sides of a middle portion of each twisted blade between a base portion and the first connecting members of each twisted blade; and wherein said turbine blades are formed so that a width of a gap along the direction of rotation of the rotor between opposite end surfaces of the first members of adjacent twisted blades and a width of a gap along the direction of rotation of the rotor between opposite end surfaces of the second members of the adjacent twisted blades are determined so as to change a mode of natural vibration when the rotor rotates at a rotating speed not higher than a rated rotating speed thereof.

* * * * *